US011594178B2

(12) United States Patent
Matsueda et al.

(10) Patent No.: US 11,594,178 B2
(45) Date of Patent: Feb. 28, 2023

(54) DISPLAY DEVICE

(71) Applicant: Wuhan Tianma Micro-Electronics Co., Ltd., Wuhan (CN)

(72) Inventors: Yojiro Matsueda, Kanagawa (JP); Jiro Yanase, Kanagawa (JP)

(73) Assignee: Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 17/457,744

(22) Filed: Dec. 6, 2021

(65) Prior Publication Data

US 2022/0199013 A1 Jun. 23, 2022

(30) Foreign Application Priority Data

Dec. 22, 2020 (JP) ..... JP2020-212735

(51) Int. Cl.
*G09G 3/3233* (2016.01)

(52) U.S. Cl.
CPC ... *G09G 3/3233* (2013.01); *G09G 2300/0842* (2013.01); *G09G 2310/061* (2013.01); *G09G 2310/08* (2013.01); *G09G 2320/0257* (2013.01)

(58) Field of Classification Search
CPC ..... G09G 3/3233; G09G 2300/0842; G09G 2310/061; G09G 2310/08; G09G 2320/0257
See application file for complete search history.

(56) References Cited

U.S. PATENT DOCUMENTS 7,365,742 B2 * 4/2008 Kim ..... G09G 3/3233 345/82
7,535,442 B2 * 5/2009 Yamashita ..... G09G 3/3266 315/169.3
7,646,364 B2 * 1/2010 Yamashita ..... G09G 3/3233 345/82
7,876,314 B2 * 1/2011 Uchino ..... G09G 3/3233 345/204
7,928,935 B2 * 4/2011 Kanda ..... G09G 3/3233 345/77
8,040,297 B2 * 10/2011 Chung ..... G09G 3/3266 315/169.3
2004/0070557 A1 * 4/2004 Asano ..... G09G 3/3233 345/76
2005/0200575 A1 9/2005 Kim et al.
(Continued)

*Primary Examiner* — Jeff Piziali
(74) *Attorney, Agent, or Firm* — Sughrue Mion, PLLC

(57) ABSTRACT

A light-emission control switch transistor and a threshold compensation switch transistor are transistors having different conductivity types. Gate potentials at the light-emission control switch transistor and the threshold compensation switch transistor are controlled using a first control signal. A gate potential at the data signal switch transistor is controlled using a second control signal. A control circuit selects rows sequentially. in a selected one of the rows, the light-emission control switch transistor is maintained off, the threshold compensation switch transistor is maintained on, and the data signal switch transistor is maintained off in a first period. In the selected row, the light-emission control switch transistor is maintained on, the threshold compensation switch transistor is maintained off, and the data signal switch transistor is maintained on in a second period after the first period.

9 Claims, 7 Drawing Sheets

(56) References Cited

U.S. PATENT DOCUMENTS

| | | | | |
|---|---|---|---|---|
| 2010/0134388 | A1* | 6/2010 | Maekawa | G09G 3/3233 345/76 |
| 2014/0139502 | A1* | 5/2014 | Han | G09G 3/3233 345/212 |
| 2019/0114967 | A1* | 4/2019 | Yin | G09G 3/3291 |
| 2020/0027402 | A1* | 1/2020 | Xiao | G09G 3/3258 |

* cited by examiner

DISPLAY DEVICE

CROSS-REFERENCE TO RELATED APPLICATIONS

This non-provisional application claims priority under 35 U.S.C. § 119(a) on Patent Application No. 2020-212735 filed in Japan on Dec. 22, 2020, the entire content of which is hereby incorporated by reference.

BACKGROUND

The present disclosure relates to a display device.

An organic light-emitting diode (OLED) element is a current-driven spontaneous light-emitting element. This produces advantages in terms of eliminating the need for backlight, obtaining low power consumption, a wide viewing angle, and a high contrast ratio, etc., so that it is expected to be used in development of flat panel displays.

An OLED display device of active matrix type includes a transistor for selecting a pixel and a driving transistor for supplying a current to the pixel. The transistors in the OLED display device are generally thin film transistors (TFTs), and low temperature polysilicon (LTPS) TFTs are widely used.

The TFT has fluctuation in threshold voltage or charge mobility. As the driving transistor determines the light emission intensity of the OLED display device, such fluctuation in electrical characteristics causes a problem. In response to this, the OLED display device generally used is provided with a compensation circuit for compensating for fluctuation or change in threshold voltage for the driving transistor.

For example, a residual image may be caused on the OLED display device and this phenomenon is called image retention. If a black-and-white checkered pattern is displayed for a particular period of time and then an intermediate tone is intended to be displayed on an entire screen, a residual image of the checkered pattern in a different tone is displayed for a while, for example.

This results from history effect produced by the driving transistor. The history effect means a phenomenon that a difference is caused between a drain current determined when a gate-to-source voltage changes from a high voltage to a low voltage and a drain current determined when the gate-to-source voltage changes from a low voltage to a high voltage.

Specifically, as a difference is caused between the drain current determined by switching from black to an intermediate tone and the drain current determined by switching from white to an intermediate tone, the light-emission intensity of the OLED display device is changed. This difference in the drain current lasts for several frames or more to become visually recognizable as the residual image. Such behavior of the drain current is called current transient response characteristics due to the history effect.

SUMMARY

An aspect of this disclosure is a display device including: pixel circuits in a plurality of rows; and a control circuit. Each pixel circuit of the pixel circuits in the plurality of rows includes: a driving transistor that controls the amount of current into a light-emitting element; a light-emission control switch transistor that switches between on and off of current supply to the light-emitting element; a storage capacitor part with a first capacitor and a second capacitor connected in series from a power supply line; a threshold compensation switch transistor for applying a threshold compensation voltage to the storage capacitor part; and a data signal switch transistor for applying a data signal to the storage capacitor part. The light-emission control switch transistor and the threshold compensation switch transistor are transistors having different conductivity types. A gate potential at the light-emission control switch transistor and a gate potential at the threshold compensation switch transistor are controlled using a first control signal. A gate potential at the data signal switch transistor is controlled using a second control signal. A gate potential at the driving transistor is controlled using a storage voltage at the storage capacitor part. The control circuit selects the plurality of rows sequentially. In a selected one of the rows, the light-emission control switch transistor is maintained off and the threshold compensation switch transistor is maintained on using the first control signal, and the data signal switch transistor is maintained off using the second control signal in a first period. In the selected row, the light-emission control switch transistor is maintained on and the threshold compensation switch transistor is maintained off using the first control signal, and the data signal switch transistor is maintained on using the second control signal in a second period after the first period. The first period is three times or more greater than the second period.

It is to be understood that both the foregoing general description and the following detailed description are exemplary and explanatory and are not restrictive of this disclosure.

EMBODIMENTS

Figure 1:
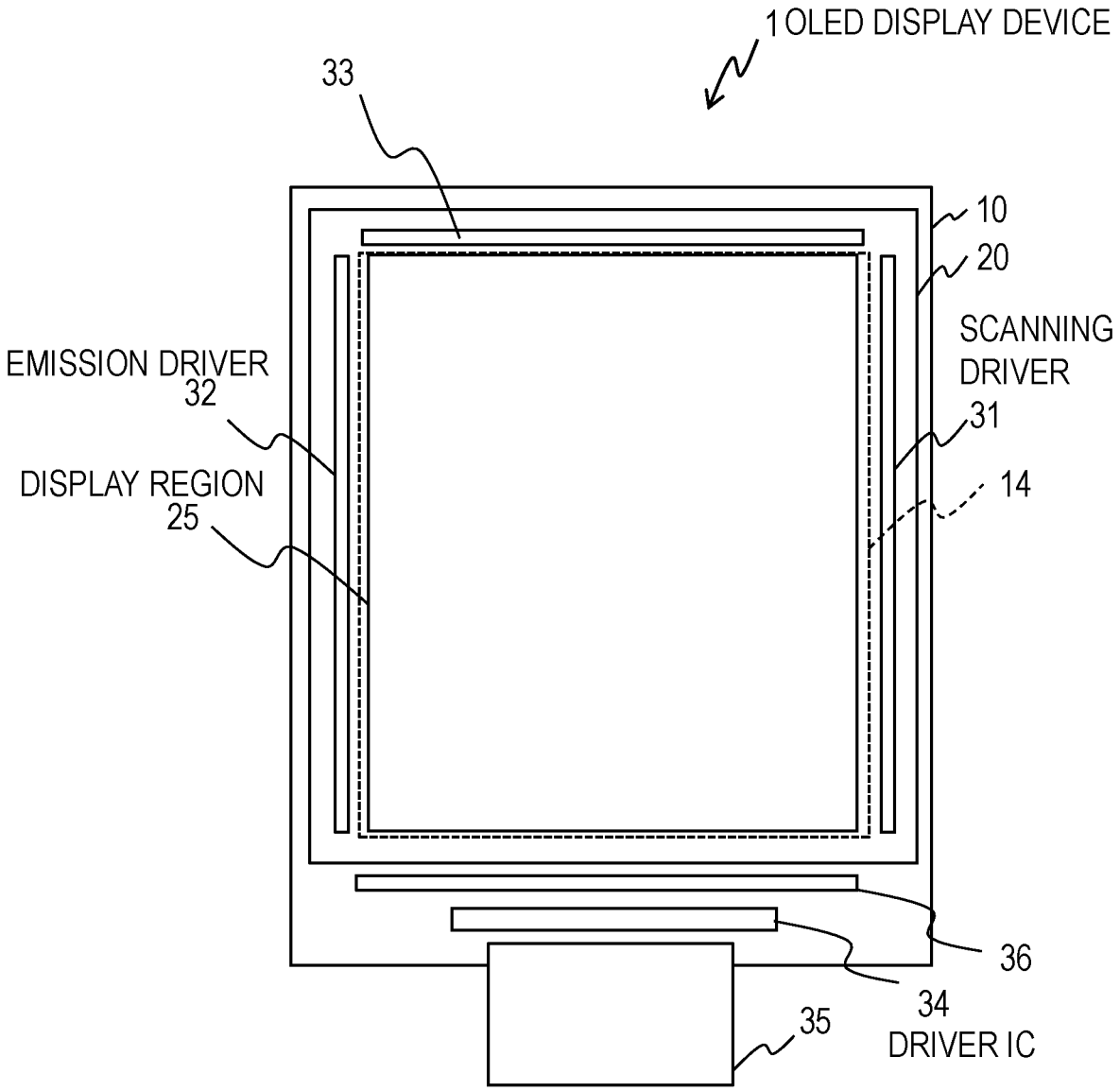
FIG. 1 schematically shows an exemplary configuration of an OLED display device as a display device.

Hereinafter, embodiments of this disclosure will be described with reference to the accompanying drawings. It should be noted that the embodiments are merely examples to implement this disclosure and not to limit the technical scope of this disclosure.

A technique disclosed in the below is to improve driving current control in a light-emitting display device using a light-emitting element to emit light in response to a driving current such as an organic light-emitting diode (OLED) display device. More specifically, the disclosed technique is to improve image quality by compensating for a threshold for a driving transistor appropriately using a small number of control signals in a pixel circuit.

For example, image retention is caused by current transient response characteristics due to the history effect of the driving transistor and characteristics of threshold voltage compensation for the driving transistor made by the pixel circuit. Image quality may be reduced not only by the image retention but also if the threshold voltage compensation for the driving transistor is insufficient.

In a display device according to one embodiment of the present specification, one control signal is applied to the gate of a switch transistor for threshold compensation for a driving transistor and to the gate of a switch transistor (light-emission control switch transistor) for light-emission control. These transistors have different conductivity types. When one of the transistors is on, the other transistor is off. In the display device, before a data signal is applied to a storage capacitor part of a pixel circuit, the transistor for threshold compensation is turned on to retain a voltage for the threshold compensation at the storage capacitor part.

Then, in the display device, the transistor for the threshold compensation is turned off and the transistor for applying the data signal is turned on to apply the data signal to the storage capacitor part. A period when a voltage for the threshold compensation is written into the storage capacitor part is longer than a period when the data signal is written into the storage capacitor part (also called a period of 1H) and may be equal to or greater than 3H, for example. Setting a long period for the threshold compensation in this way allows more appropriate threshold compensation for the driving transistor. Furthermore, the switch transistor for the threshold compensation and the switch transistor for the light-emission control having different conductivity types are controlled using a common control signal to allow reduction in the number of control signals in the pixel circuit.

As described above, in the display device according to one embodiment of the present specification, the threshold compensation for the driving transistor is made more appropriately to allow improvement of image quality. Furthermore, controlling the pixel circuit using a smaller number of control signals encourages higher definition and a narrower frame of the display device.

[Display Device Configuration]

FIG. 1 schematically shows an exemplary configuration of an OLED display device 1. The configuration of the OLED display device 1 includes a thin film transistor (TFT) substrate 10 on which an OLED element and a pixel circuit are formed, and a thin film encapsulation (TFE) structure 20 for encapsulating the organic light-emitting element. The thin film encapsulation structure 20 is one type of encapsulation structure part. As another example, the encapsulation structure part can include an encapsulation substrate encapsulating the organic light-emitting element, and a bonding part (glass frit sealing part) for bonding between the TFT substrate 10 and the encapsulation substrate. Dry nitrogen is filled in between the TFT substrate 10 and the encapsulation substrate, for example.

A scanning driver 31, an emission driver 32, a protective circuit 33, a driver IC 34, and a demultiplexer 36 are arranged around a cathode electrode forming region 14 outside a display region 25 of the TFT substrate 10. The driver IC 34 is connected to external equipment through a flexible printed circuit (FPC) 35. These circuits are included in a control circuit that controls the OLED display device 1. Some of these circuits are omissible.

The scanning driver 31 drives a scanning line on the TFT substrate 10. The emission driver 32 drives a light-emission control line to control a light-emission period of each pixel. The scanning driver 31 and the emission driver 32 are arranged on opposite sides across the display region 25. The scanning line and the light-emission control line extend in a right-left direction and are arranged in a top-bottom direction in FIG. 1, for example. The driver IC 34 is mounted using an anisotropic conductive film (ACF), for example.

The protective circuit 33 prevents electrostatic breakdown of an element in a pixel circuit. The driver IC 34 applies a power supply and a timing signal (control signal) to the scanning driver 31 and the emission driver 32. The driver IC 34 further applies the power supply and a data signal to the demultiplexer 36.

The demultiplexer 36 outputs output from one pin of the driver IC 34 to d (d is an integer equal to or greater than 2) data lines sequentially. The data lines extend in the top-bottom direction and are arranged in the right-left direction in FIG. 1, for example. The demultiplexer 36 switches data lines as destinations of a data signal from the driver IC 34 *d* times in a scanning period, thereby driving data lines of a number d times greater than the number of output pins of the driver IC 34.

As described later, each pixel circuit includes a driving TFT (driving transistor) and a storage capacitor part that retains a signal voltage used for determining a driving current for the driving TFT. The data signal transmitted through the data line is corrected in response to a threshold for the driving TFT and accumulated in the storage capacitor part. A voltage at the storage capacitor part is used for determining a gate voltage (Vgs) at the driving TFT. A conductance at the driving TFT is changed in an analog fashion using the corrected data signal to supply a forward bias current responsive to a light-emission tone to the OLED element.

[Pixel Circuit]

Some exemplary configurations of a pixel circuit according to the embodiment of the present specification will be descried below. Each transistor may have opposite conductivity types in the exemplary pixel circuits described below.

Figure 2:
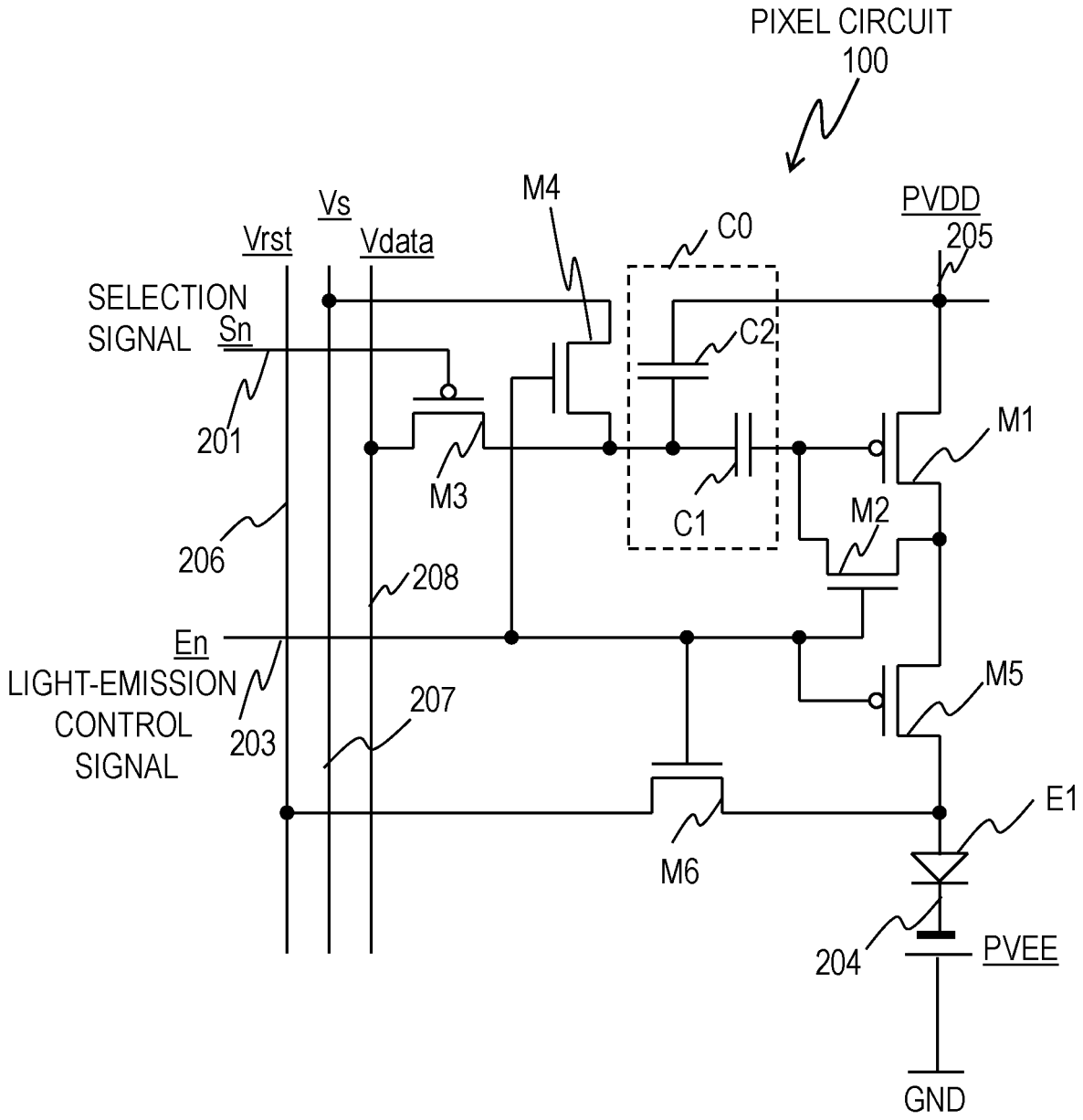
FIG. 2 shows an exemplary configuration of a pixel circuit according to the present embodiment.

FIG. 2 shows an exemplary configuration of a pixel circuit 100 according to the present embodiment. The pixel circuit 100 includes a storage capacitor part (also called a storage capacity circuit part). After a threshold compensation voltage for the driving transistor is written into the storage capacitor part, a data signal is written into the storage capacitor part. A voltage at the storage capacitor part is used for determining the amount of light emission from the OLED element.

The pixel circuit 100 is given a plurality of power supply potentials (constant potentials). These potentials include an anode power supply potential PVDD, a cathode power supply potential PVEE, a reference potential Vs, and a reset potential Vrst. In the exemplary configuration shown in FIG. 2, the reference potential Vs for applying a potential for detecting a threshold for the driving transistor can be the same as the anode power supply potential PVDD. Alternatively, another potential lower than the anode power supply potential PVDD may be applied as the reference potential Vs. However, the reference potential Vs at a too low level prohibits an image signal from being written correctly. Thus, the reference potential Vs is desirably higher than that of a data signal Vdata.

Regarding the reset potential Vrst for bringing an OLED element E1 to a non light-emitting state by discharging redundant charge accumulated in the OLED element E1, this potential is required to be similar to the cathode power supply potential PVEE or required to be set to a potential lower than a value obtained by adding a threshold voltage for the OLED element E1 to the cathode power supply potential PVEE. As a result, the anode power supply potential PVDD becomes a maximum value, the cathode power supply potential PVEE becomes a minimum value, the reference potential Vs becomes a value similar to or slightly lower than the anode power supply potential PVDD, and the reset potential Vrst becomes a value similar to or slightly higher than the cathode power supply potential PVEE.

The pixel circuit 100 includes six transistors (TFTs) M1 to M6 each having a gate, a source, and a drain. In this example, the transistors M1, M3, and M5 are P-type TFTs. The transistors M2, M4, and M6 are N-type TFTs. The P-type TFT is a low-temperature polysilicon TFT, for example. The N-type TFT is an oxide semiconductor TFT, for example. The low-temperature polysilicon TFT has large electron mobility as its characteristics. The oxide semiconductor TFT has a low leakage current as its characteristics. Examples of the oxide semiconductor include InGaZnO, ZnO, and ZTO.

The transistor M1 is a driving transistor that controls the amount of current into the OLED element E1. The driving transistor M1 controls the amount of current to be applied from an anode power supply for applying the power supply potential PVDD to the OLED element E1 in response to a voltage retained at a storage capacitor part C0. The storage capacitor part C0 retains a written voltage for one frame period.

A conductance at the driving transistor M1 is changed in an analog fashion using the storage voltage, and the driving transistor M1 outputs a forward bias current responsive to a light-emission tone to the OLED element E1. The OLED element E1 has a cathode connected to a power supply line 204 for transmitting the power supply potential PVEE supplied from a cathode power supply.

In the exemplary configuration shown in FIG. 2, the storage capacitor part is composed of a capacitor C1 and a capacitor C2 connected in series. The storage capacitor part C0 has one end to which the anode power supply potential PVDD is applied, and another end connected to the gate of the driving transistor M1. More specifically, the capacitors C1 and C2 are connected in series between a power supply line 205 for applying the anode power supply potential PVDD and the gate of the driving transistor M1. The capacitor C1 has one end connected to the gate of the driving transistor M1. The capacitor C2 has one end connected to the power supply line 205.

A voltage at the storage capacitor part C0 is a voltage between the gate of the driving transistor M1 and the anode power supply line 205. The driving transistor M1 has a source connected to the anode power supply line 205 and a source potential is the anode power supply potential PVDD. In this way, the storage capacitor part C0 retains a gate-to-source voltage (also called a gate voltage simply) at the driving transistor M1.

The transistor M5 is a switch transistor that controls on/off of light emission from the OLED element E1. The transistor M5 controls on/off of light emission from the OLED element E1. The transistor M5 has a source connected to the drain of the driving transistor M1. The transistor M5 switches between on and off of current supply to the OLED element E1 connected to the drain of the transistor M5. The transistor M5 has a gate connected to a light-emission control line 203. The transistor M5 is controlled using a light-emission control signal (first control signal) En (n is a natural number) input from the emission driver (first control driver) 32 to the gate of the transistor M5.

The transistor (reset switch transistor) M6 operates for supplying the reset potential Vrst to the anode of the OLED element E1. One terminal that is either the source or the drain of the transistor M6 is connected to a power supply line 206 for transmitting the reset potential Vrst, and the other terminal thereof is connected to the anode of the OLED element E1.

The transistor M6 has a gate connected to the light-emission control line 203. The transistor M6 is controlled using the light-emission control signal En. The transistor M6 has a conductivity type differing from that of the transistor M5. When the transistor M6 is turned on in response to the light-emission control signal En input to the gate thereof from the emission driver 32, the transistor M6 applies the reset potential Vrst transmitted through the power supply line 206 to the anode of the OLED element E1.

The transistor M2 is a switch transistor for writing a voltage for threshold compensation for the driving transistor M1 into the storage capacitor part C0. The transistor M2 has a source and a drain that connect the gate and the drain of the driving transistor M1 to each other. Thus, when the transistor M2 is on, the driving transistor M1 is in a diode-connected state.

The transistor M2 is an N-type transistor and has a conductivity type differing from that of the light-emission control transistor M5 (P type). Like the transistor M5, the transistor M2 is controlled using the light-emission control signal En. Thus, when the transistor M2 is on, the transistor M5 is off. When the transistor M2 is off, the transistor M5 is on.

The transistor M4 is a switch transistor for writing a voltage for threshold compensation for the driving transistor M1 into the storage capacitor part C0. The transistor M4 controls the presence or absence of supply of the reference potential Vs to the storage capacitor part C0. One terminal that is either the source or the drain of the transistor M4 is connected to a power supply line 207 for transmitting the reference potential Vs, and the other terminal thereof is connected to a node between the capacitors C1 and C2. The transistor M4 has a gate connected to the light-emission control line 203. The transistor M4 is controlled using the light-emission control signal En input from the emission driver 32 to the gate thereof.

The transistor M4 is an N-type transistor and has a conductivity type differing from that of the light-emission control transistor M5 (P type). Like the transistor M5, the transistor M4 is controlled using the light-emission control signal En. Thus, when the transistor M4 is on, the transistor M5 is off. When the transistor M4 is off, the transistor M5 is on.

The transistors M2 and M4 have the same conductivity type and are controlled using the same control signal En. For this reason, the transistors M2 and M4 are turned on or off simultaneously. When the transistors M2 and M4 are on, the transistor M1 forms a diode-connected transistor. A threshold compensation voltage is written into the storage capacitor part C0 between the power supply potential PVDD and the reference potential Vs.

The transistor M3 is a switch transistor for selecting a pixel circuit to which a data signal is to be supplied and for writing a data signal (data signal voltage) into the storage capacitor part C0. One terminal that is either the source or the drain of the transistor M3 is connected to a data line 208 for transmitting the data signal Vdata, and the other terminal thereof is connected to the storage capacitor part C0. More specifically, the one terminal that is either the source or the drain of the transistor M3 is connected to the node between the capacitors C1 and C2.

The transistor M3 has a gate connected to a scanning line 201 for transmitting a selection signal (second control signal) Sn. The transistor M3 is controlled using the selection signal Sn supplied from the scanning driver (second control driver) 31. When the transistor M3 is on, the transistor M3 applies the data signal Vdata to the storage capacitor part C0 having been supplied from the driver IC 34 through the data line 208.

A plurality of the pixel circuits 100 is connected to the scanning line 201 and the light-emission control line 203. These pixel circuits 100 in a group may be called pixel circuit rows, and pixels in a group in these pixel circuit rows may be called pixel rows. Different pixel circuit rows are connected to a different pair of a scanning line and a light-emission control line.

[Control over Pixel Circuit]

Figure 3:
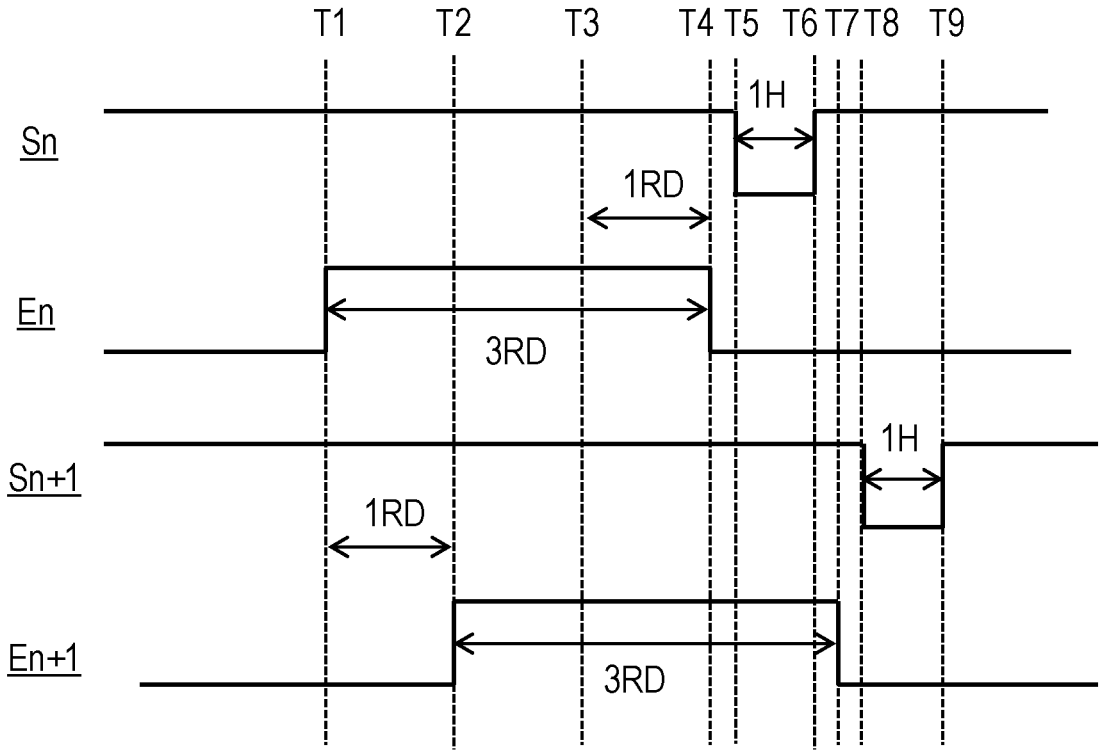
FIG. 3 shows a timing chart for signals used for controlling the pixel circuit shown in FIG. 2.

FIG. 3 shows a timing chart for signals used for controlling the pixel circuit 100 shown in FIG. 2. The timing chart shown in FIG. 3 is for writing a threshold compensation voltage for the driving transistor M1 and the data signal Vdata into a pixel circuit in an n-th row. More specifically, FIG. 3 shows change with time in a selection signal Sn for selecting an n-th pixel circuit row into which the data signal Vdata is to be written, in a light-emission control signal En for the n-th pixel circuit row, in a selection signal Sn+1 for a n+1-th pixel circuit row, and in a light-emission control signal En+1 for the n+1-th pixel circuit row.

In the timing chart shown in FIG. 3, a period of 1H is a period when a selection signal is low. Specifically, this is a period when the data signal Vdata is written into the pixel circuit 100. A period of 1RD is a reference period and longer than a period of 1H. A period when a light-emission control signal is high is a period of 3RD.

At time T1, the light-emission control signal En changes from low to high. In response to the change in the light-emission control signal En, the transistor M5 is turned off and the transistors M2, M4, and M6 are turned on. The selection signal Sn is high at the time T1, so that the transistor M3 is off.

As the transistors M2 and M4 are on, a voltage for compensating for a threshold for the driving transistor M1 is written into the storage capacitor part C0. Also, as the transistor M6 is on, the reset potential Vrst is applied to the anode of the OLED element E1. The foregoing states of the transistors M1 to M6 are maintained in a period from the time T1 to time T2. A period when the voltage for compensating for the threshold for the driving transistor M1 is written is a period of 3RD.

At the time T2 after passage of a period of 1RD from the time T1, the light-emission control signal En+1 changes from low to high. At the time T2, the selection signals Sn and Sn+1 remain high and the light-emission control signal En remains high. A pixel circuit in a row n maintains the same state as that at the time T1. In the pixel circuit in a row n+1, the transistor M5 is turned off and the transistors M2, M4, and M6 are turned on. Specifically, writing of a threshold compensation voltage and reset of an anode potential at the OLED element E1 are started. At time T3 after passage of a period of 1RD from the time T2, a light-emission control signal (not shown in the drawings) in a row n+2 changes from low to high.

At time T4 after passage of a period of 1RD from the time T3, the light-emission control signal En changes from high to low. In response to the change in the light-emission control signal En, the transistor M5 is turned on and the transistors M2, M4, and M6 are turned off. At the time T4, writing of the threshold compensation voltage into and supply of the reset potential to the pixel circuit are finished. The length of a period (first period) from the time T1 to the time T4 is 3RD.

At time T5 after the time T4, the selection signal Sn changes from high to low. In the example shown in FIG. 3, a time difference between the time T4 and the time T5 is approximately a value obtained as follows: (1RD−1H)/2. In response to the change in the selection signal Sn, the transistor M3 changes from off to on. The data signal Vdata is written from the data line 208 into the storage capacitor part C0 through the transistor M3.

At time T6 after passage of a period of 1H from the time T5, the selection signal Sn changes from low to high. In response to the change in the selection signal Sn, the transistor M3 changes from on to off. At the time T6, writing of the data signal Vdata into the pixel circuit in the row n is finished. As described above, a period (second period) of writing of the data signal Vdata from the time T5 to the time T6 is a period of 1H.

As described above, in response to the foregoing changes with time in the selection signal Sn and the light-emission control signal En in a period from the time T1 to the time T6, the pixel circuit 100 in the row n is controlled in one frame.

At time T7 after the time T6, the light-emission control signal En+1 changes from high to low. A time difference exists between the time T6 when the selection signal Sn is off and the time T7 when the light-emission control signal En+1 changes to low. In the example shown in FIG. 3, this time difference is obtained as follows: (1RD−1H)/2.

In response to the change in the light-emission control signal En+1, the transistor M5 is turned on and the transistors M2, M4, and M6 are turned off in the pixel circuit in the row n+1. At the time T7, writing of the threshold compensation voltage into the pixel circuit and supply of the reset potential to the anode of the OLED element E1 are finished. The length of a period (first period) from the time T2 to the time T7 is 3RD.

At time T8 after the time T7, the selection signal Sn+1 changes from high to low. In the example shown in FIG. 3, a time difference between the time T7 and the time T8 is obtained as follows: (1RD−1H)/2. In response to the change in the selection signal Sn+1, the transistor M3 changes from off to on in the pixel circuit in the row n+1. The data signal Vdata is written from the data line 208 into the storage capacitor part C0 through the transistor M3.

At time T9 after passage of a period of 1H from the time T8, the selection signal Sn+1 changes from low to high. In response to the change in the selection signal Sn+1, the transistor M3 changes from on to off in the pixel circuit in the row n+1. Writing of the data signal Vdata into the pixel circuit in the row n+1 is finished at the time T9. As described above, a period (second period) of writing of the data signal Vdata from the time T8 to the time T9 is a period of 1H.

As described by referring to FIG. 3, the selection signal Sn and the selection signal Sn+1 are synchronous with each other and are shifted in phase by 1RD corresponding to the reference period. The light-emission control signal En and the light-emission control signal En+1 are synchronous with each other and are shifted in phase by 1RD corresponding to the reference period. A period when the light-emission control signal is high is 3RD, and three continuous light-emission control lines are high and the other light-emission control lines are low in each period of 1RD.

As described above, a period when the light-emission control line is high and when the threshold compensation voltage is written into the pixel circuit is 3RD. This period is three times or more greater than a period of 1H when the data signal in the pixel circuit is written. As a period for the threshold compensation is three times or more greater than the period of writing of the data signal, it becomes possible to make the threshold compensation for the driving transistor more appropriately. In another example, the period for the threshold compensation may be 1H or 2H. The period for the threshold compensation may be equal to or greater than 4RD.

As the pixel circuit is controlled using the selection signal Sn and the light-emission control signal En, the pixel circuit is controllable using two shift transistors. As illustrated in FIG. 1, arranging the scanning driver 31 and the emission driver 32 on the opposite sides of the display region 25 makes it possible to narrow a frame region to a greater extent.

As described by referring to FIG. 3, a time difference exists between a falling edge of the light-emission control signal En and a falling edge of the selection signal Sn. This makes it possible to write the data signal more correctly into the storage capacitor part C0. A certain margin is also ensured from a rising edge of the selection signal Sn to falling edge of the light-emission control signal En+1 in a next stage. This is intended to prevent switching noise occurring when a data voltage in a previous stage is fixed from being combined as error with a gate potential at the driving transistor during detection of Vth as a result of capacitive coupling.

As described above, the exemplary configuration of the pixel circuit described by referring to FIGS. 2 and 3 includes the first threshold compensation switch transistor M4 and the second threshold compensation switch transistor M2. The storage capacitor part C0 includes the first capacitor C1 and the second capacitor C2 connected in series between the power supply line 205 for transmitting the power supply potential PVDD and the gate of the driving transistor M1.

The first threshold compensation switch transistor M4 in an on state supplies the reference potential Vs to the node between the first capacitor C1 and the second capacitor C2. The second threshold compensation switch transistor M2 in an on state connects the gate and the drain of the driving transistor M1 to each other. The data signal switch transistor M3 in an on state supplies the data signal to the node between the first capacitor C1 and the second capacitor C2.

[Simulation Result about Pixel Circuit]

Figure 4:
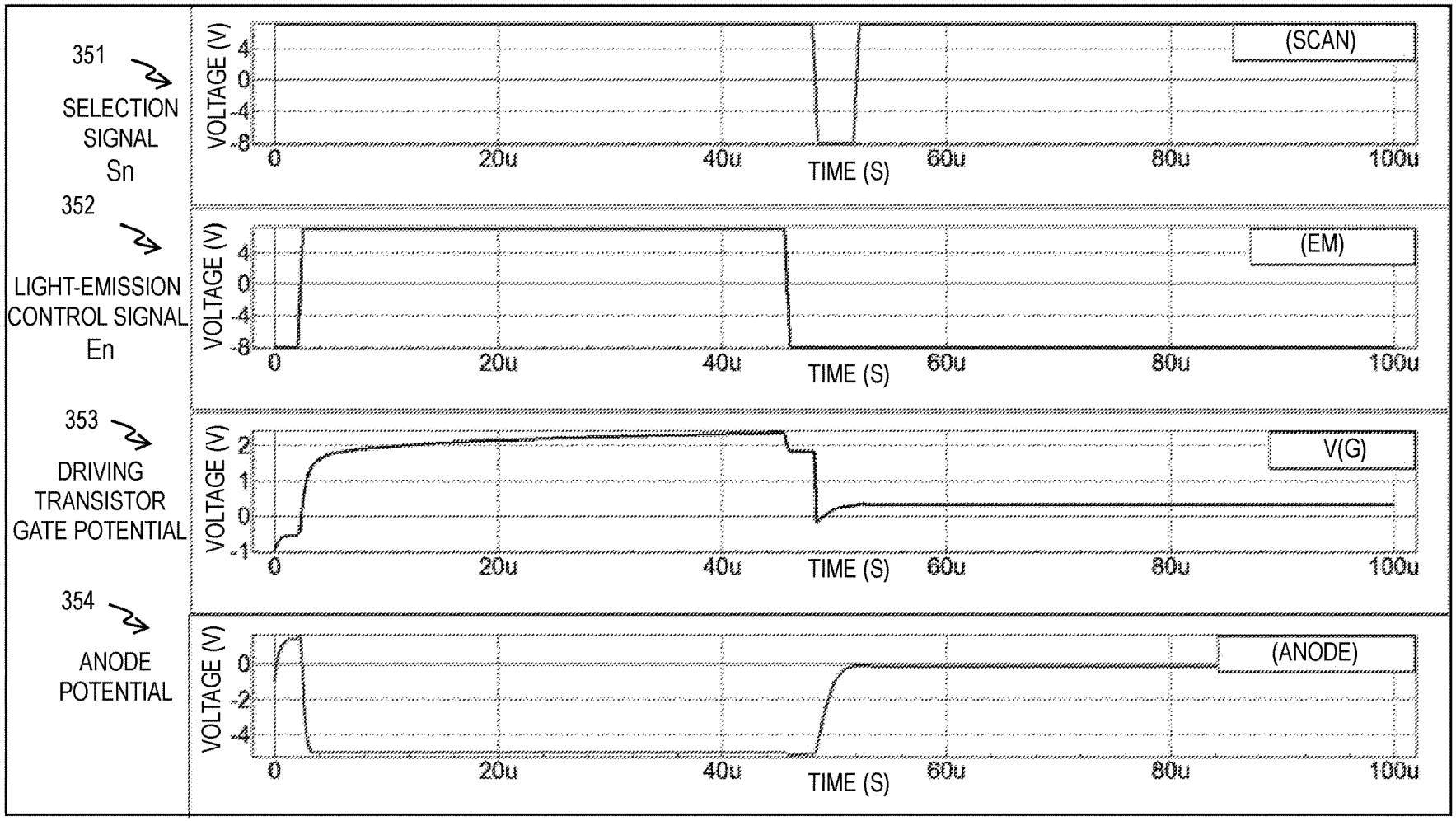
FIG. 4 shows simulation result about signal change occurring in the pixel circuit according to one embodiment of the present specification.

FIG. 4 shows simulation result about signal change occurring in the pixel circuit according to one embodiment of the present specification. FIG. 4 shows a graph 351 showing change with time in the selection signal Sn, a graph 352 showing change with time in the light-emission control signal En, a graph 353 showing change with time in a gate potential at the driving transistor, and a graph 354 showing change with time in an anode potential at the OLED element.

In a period when the light-emission control signal En is high, a gate potential at the driving transistor changes to a potential responsive to a threshold. An anode potential at the OLED element changes to a reset potential. The light-emission control signal En changes from high to low, and the selection signal Sn changes from high to low. In a period when the selection signal Sn is low, the gate potential at the driving transistor changes to a potential responsive to a data signal. As shown in FIG. 4, the pixel circuit and the control of the present specification make it possible to reset the anode potential at the OLED element and to apply a data signal compensated for in terms of threshold to the gate of the driving transistor.

Figure 5:
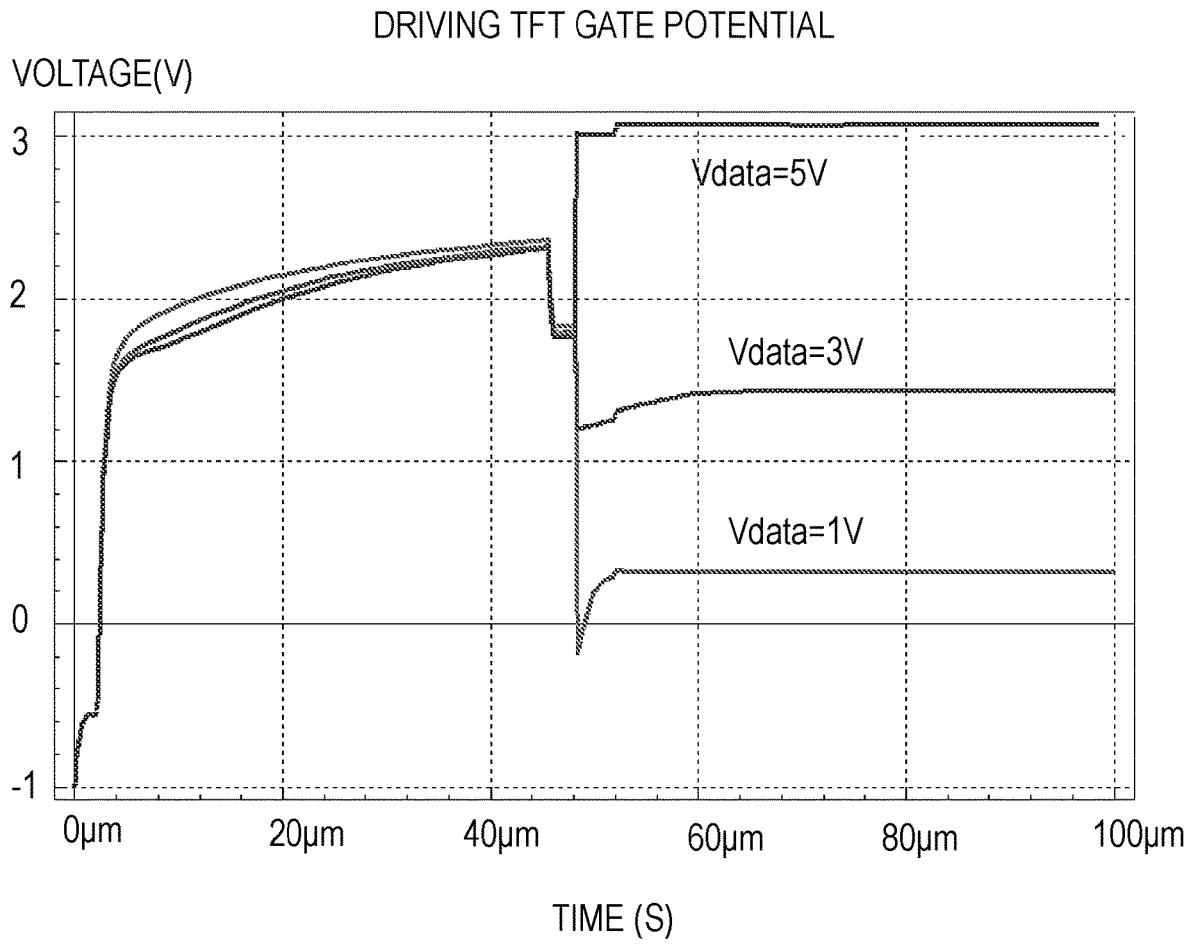
FIG. 5 shows simulation result about change with time in gate potential at a driving transistor relative to different data signals occurring in the pixel circuit according to one embodiment of the present specification.

FIG. 5 shows simulation result about change with time in gate potential at the driving transistor relative to different data signals occurring in the pixel circuit according to one embodiment of the present specification. FIG. 5 shows change with time in the gate potential at the driving transistor relative to the data signal Vdata at 1 V, 3 V, and 5 V. As shown in FIG. 5, in the present embodiment, the gate potential at the driving transistor is settable to an appropriate value in response to different data signals.

[Other Pixel Circuits]

Figure 6:
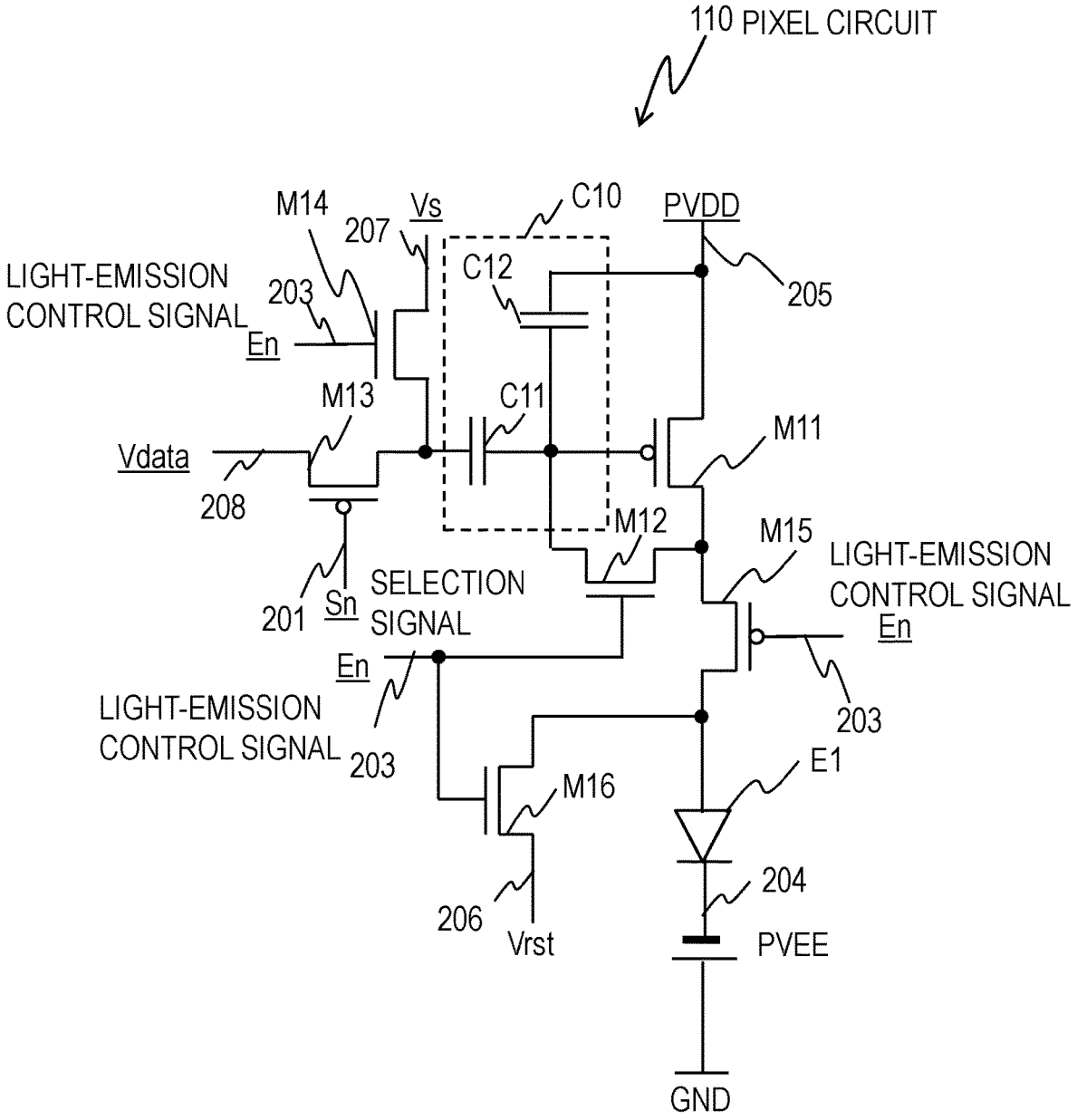
FIG. 6 shows a pixel circuit of a different exemplary configuration according to one embodiment of the present specification.

FIG. 6 shows a pixel circuit 110 of a different exemplary configuration according to one embodiment of the present specification. The pixel circuit 110 includes six transistors (TFTs) M11 to M16 each having a gate, a source, and a drain. In this example, the transistors M11, M13, and M15 are P-type TFTs. The transistors M12, M14, and M16 are N-type TFTs.

The transistor M11 is a driving transistor that controls the amount of current into the OLED element E1. The driving transistor M11 controls the amount of current to be applied from the anode power supply for applying the power supply potential PVDD to the OLED element E1 in response to a voltage retained at a storage capacitor part C10. The storage capacitor part C10 retains a written voltage for one frame period. The OLED element E1 has a cathode connected to the power supply line 204 for transmitting the power supply potential PVEE from the cathode power supply.

In the exemplary configuration shown in FIG. 6, the storage capacitor part C10 is composed of a capacitor C11 and a capacitor C12 connected in series. The storage capacitor part C10 has one end to which the anode power supply potential PVDD is applied, and another end connected to a source or a drain of the switch transistor M13 and to a source or a drain of the switch transistor M14. The storage capacitor part C10 further has another end connected to the gate of the driving transistor M11. More specifically, the capacitor C12 has one end connected to the power supply line 205. The capacitor C11 has one end connected to the source or the drain of the switch transistor M13 and to the source or the drain of the switch transistor M14. An intermediate node between the capacitors C11 and C12 is connected to the gate of the driving transistor M11.

A voltage at the storage capacitor part C10 is a voltage between the gate of the driving transistor M11 and the anode power supply line 205. The driving transistor M11 has a source connected to the anode power supply line 205 and a source potential is the anode power supply potential PVDD. In this way, the storage capacitor part C10 retains a gate-to-source voltage at the driving transistor M11. In the exemplary configuration shown in FIG. 6, the capacitor C12 retains the gate-to-source voltage at the driving transistor M11.

The transistor M15 is a switch transistor that controls on/off of light emission from the OLED element E1. The transistor M15 has a source connected to the drain of the driving transistor M11. The transistor M15 switches between on and off of current supply to the OLED element E1 connected to the drain of the transistor M15. The transistor M15 has a gate connected to the light-emission control line 203. The transistor M15 is controlled using the light-emission control signal En input from the emission driver 32 to the gate of the transistor M15.

The transistor (reset switch transistor) M16 operates for supplying the reset potential Vrst to the anode of the OLED element E1. One terminal that is either the source or the drain of the transistor M16 is connected to the power supply line 206 for transmitting the reset potential Vrst, and the other terminal thereof is connected to the anode of the OLED element E1.

The transistor M16 has a gate connected to the light-emission control line 203. The transistor M16 is controlled using the light-emission control signal En. The transistor M16 has a conductivity type differing from that of the transistor M15. When the transistor M16 is turned on in response to the light-emission control signal En input to the gate thereof from the emission driver 32, the transistor M16 applies the reset potential Vrst transmitted through the power supply line 206 to the anode of the OLED element E1.

The transistor M12 is a switch transistor for writing a voltage for threshold compensation for the driving transistor M11 into the storage capacitor part C10. The transistor M12 has a source and a drain that connect the gate and the drain of the driving transistor M11 to each other. Thus, when the transistor M12 is on, the driving transistor M11 is in a diode-connected state.

The transistor M12 is an N-type transistor and has a conductivity type differing from that of the light-emission control transistor M15 (P type). Like the transistor M15, the transistor M12 is controlled using the light-emission control signal En. Thus, when the transistor M12 is on, the transistor M15 is off. When the transistor M12 is off, the transistor M15 is on.

The transistor M14 is a switch transistor for writing a voltage for threshold compensation for the driving transistor M11 into the storage capacitor part C10. The transistor M14 controls the presence or absence of supply of the reference potential Vs to the storage capacitor part C10. One terminal that is either the source or the drain of the transistor M14 is connected to the power supply line 207 for transmitting the reference potential Vs, and the other terminal thereof is connected to the one end of the capacitor C11. The transistor M14 has a gate connected to the light-emission control line 203. The transistor M14 is controlled using the light-emission control signal En input from the emission driver 32 to the gate thereof.

The transistor M14 is an N-type transistor and has a conductivity type differing from that of the light-emission control transistor M15 (P type). Like the transistor M15, the transistor M14 is controlled using the light-emission control signal En. Thus, when the transistor M14 is on, the transistor M15 is off. When the transistor M14 is off, the transistor M15 is on.

The transistors M12 and M14 have the same conductivity type and are controlled using the same control signal En. For this reason, the transistors M12 and M14 are turned on or off simultaneously. When the transistors M12 and M14 are on, the transistor M11 forms a diode-connected transistor. A threshold compensation voltage is written into the storage capacitor part C10 between the power supply potential PVDD and the reference potential Vs.

The transistor M13 is a switch transistor for selecting a pixel circuit to which a data signal is to be supplied and for writing a data signal (data signal voltage) into the storage capacitor part C10. One terminal that is either the source or the drain of the transistor M13 is connected to the data line 208 for transmitting the data signal Vdata, and the other terminal thereof is connected to the storage capacitor part C10. More specifically, the one terminal that is either the source or the drain of the transistor M13 is connected to the one end of the capacitor C11.

The transistor M13 has a gate connected to the scanning line 201 for transmitting the selection signal Sn. The transistor M13 is controlled using the selection signal Sn supplied from the scanning driver 31. When the transistor M13 is on, the transistor M13 applies the data signal Vdata to the storage capacitor part C10 having been supplied from the driver IC 34 through the data line 208.

The exemplary configuration of the pixel circuit described by referring to FIG. 6 includes the first threshold compensation switch transistor M14 and the second threshold compensation switch transistor M12. The storage capacitor part includes the first capacitor C11 and the second capacitor C12 connected in series between the power supply line 205 for transmitting the power supply potential PVDD, and the source or the drain of the first threshold compensation switch transistor M14 and the source or the drain of the data signal switch transistor M13. A potential at the node between the first capacitor C11 and the second capacitor C12 is applied to the gate of the driving transistor M11. The second threshold compensation switch transistor M12 in an on state connects the gate and the drain of the driving transistor M11 to each other.

A timing chart for signals used for controlling the pixel circuit 110 is similar to that shown in FIG. 3. In the pixel circuit 110, using the two control signals Sn and En also allows a threshold compensation for the driving transistor to be made correctly, allows an anode potential at the OLED element to be reset, and allows a data signal to be written appropriately.

Figure 7:
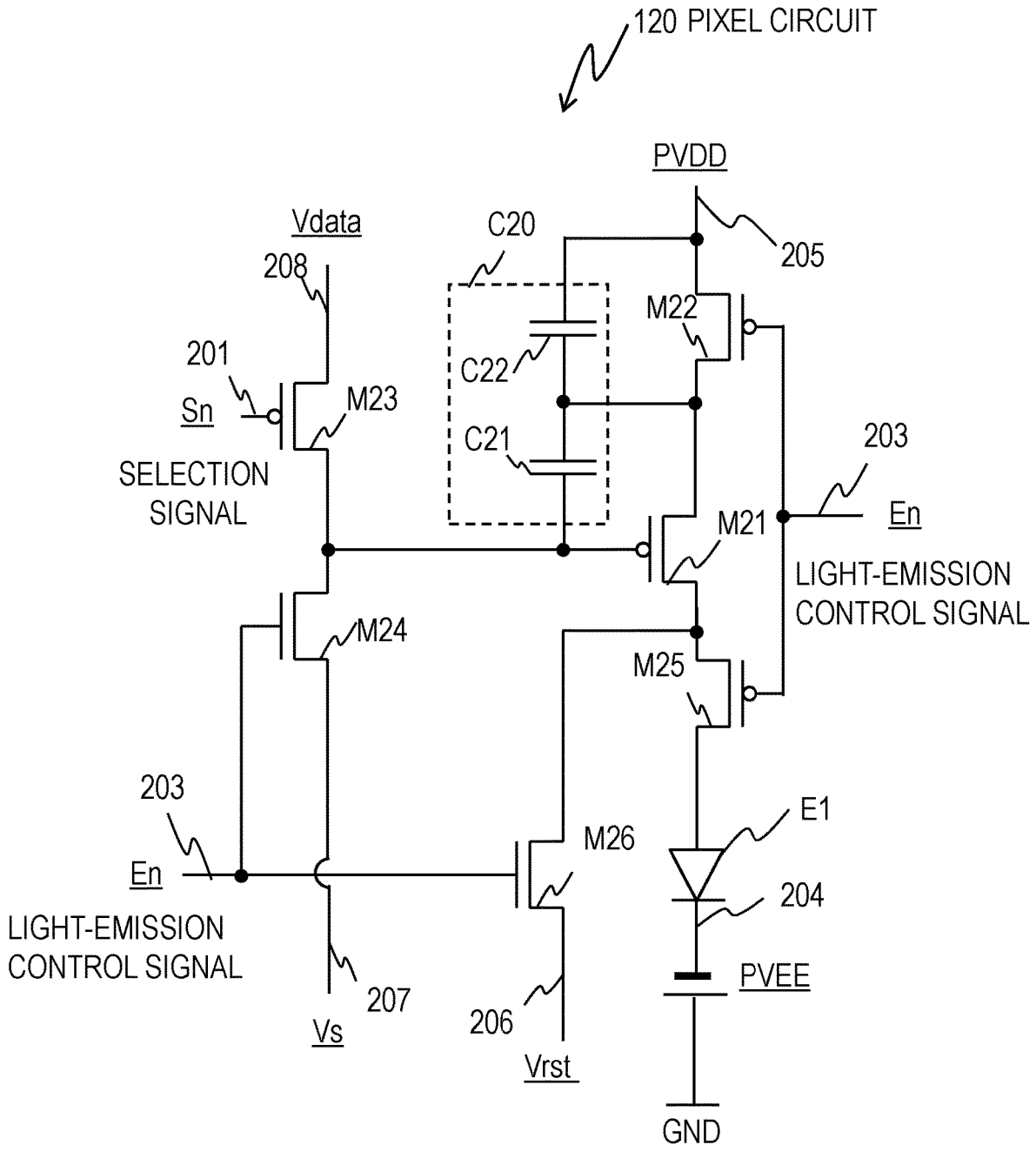
FIG. 7 shows a pixel circuit of a different exemplary configuration according to one embodiment of the present specification.

FIG. 7 shows a pixel circuit 120 of a different exemplary configuration according to one embodiment of the present specification. The pixel circuit 120 includes six transistors (TFTs) M21 to M26 each having a gate, a source, and a drain. In this example, the transistors M21, M22, M23, and M25 are P-type TFTs. The transistors M24 and M26 are N-type TFTs.

The transistor M21 is a driving transistor that controls the amount of current into the OLED element E1. The driving transistor M21 controls the amount of current to be applied from the anode power supply for applying the power supply potential PVDD to the OLED element E1 in response to a voltage retained at a storage capacitor part C20. The storage capacitor part C20 retains a written voltage for one frame period. The OLED element E1 has a cathode connected to the power supply line 204 for transmitting the power supply potential PVEE from the cathode power supply.

In the exemplary configuration shown in FIG. 7, the storage capacitor part C20 is composed of a capacitor C21 and a capacitor C22 connected in series. The storage capacitor part C20 has one end to which the anode power supply potential PVDD is applied, and another end connected to the gate of the driving transistor M21. More specifically, the capacitor C22 has one end connected to the power supply line 205. The capacitor C21 has one end connected to the gate of the driving transistor M21. An intermediate node between the capacitors C11 and C12 is connected to the source of the driving transistor M21.

A voltage at the storage capacitor part C20 is a voltage between the gate of the driving transistor M21 and the anode power supply line 205. The driving transistor M21 has a source connected to the anode power supply line 205 through the switch transistor M22. In this way, the storage capacitor part C20 retains a gate-to-source voltage at the driving transistor M21.

The transistors M22 and M25 are switch transistors that control on/off of light emission from the OLED element E1. The transistor M22 has a source to which the power supply potential PVDD is applied, and a drain connected to the source of the driving transistor M21. The transistor M25 has a source connected to the drain of the driving transistor M21.

The transistors M22 and M25 switch between on and off of current supply to the OLED element E1. The transistors M22 and M25 have respective gates connected to the light-emission control line 203. The transistors M22 and M25 are controlled in the same way using the light-emission control signal En input from the emission driver 32 to their respective gates.

The transistor (reset switch transistor) M26 operates for supplying the reset potential Vrst to the anode of the OLED element E1. One terminal that is either the source or the drain of the transistor M26 is connected to the power supply line 206 for transmitting the reset potential Vrst, and the other terminal thereof is connected to the anode of the OLED element E1.

The transistor M26 has a gate connected to the light-emission control line 203. The transistor M26 is controlled using the light-emission control signal En. The transistor M26 has a conductivity type differing from those of the transistors M22 and M25. When the transistor M26 is turned on in response to the light-emission control signal En input to the gate thereof from the emission driver 32, the transistor M26 applies the reset potential Vrst transmitted through the power supply line 206 to the anode of the OLED element E1.

The transistors M24 and M26 are switch transistors for writing a voltage for threshold compensation for the driving transistor M21 into the storage capacitor part C20. The transistor M24 controls the presence or absence of supply of the reference potential Vs to the storage capacitor part C20. The transistor M26 controls the presence or absence of supply of the reset potential Vrst to the drain of the driving transistor M21.

One terminal that is either the source or the drain of the transistor M24 is connected to the power supply line 207 for transmitting the reference potential Vs, and the other terminal thereof is connected the one end of the capacitor C21. The transistor M24 has a gate connected to the light-emission control line 203. The transistor M24 is controlled using the light-emission control signal En input from the emission driver 32 to the gate thereof.

One terminal that is either the source or the drain of the transistor M26 is connected to the power supply line 206 for transmitting the reset potential Vrst, and the other terminal thereof is connected between the drain of the driving transistor M21 and the source of the switch transistor M25. The transistor M26 has a gate connected to the light-emission control line 203. The transistor M26 is controlled using the light-emission control signal En input from the emission driver 32 to the gate thereof.

The transistors M24 and M26 are N-type transistors and have conductivity types differing from those of the light-emission control transistors M22 and M25 (P type). Like the transistors M22 and M25, the transistors M24 and M26 are controlled using the light-emission control signal En. Thus, when the transistors M24 and M26 are on, the transistors M22 and M25 are off. When the transistors M24 and M26 are off, the transistors M22 and M25 are on.

The transistors M24 and M26 have the same conductivity type and are controlled using the same control signal En. When the transistors M24 and M26 are on, the driving transistor M21 forms a source follower circuit and a threshold voltage therefor is written into the capacitor C21 between the gate and the source of the driving transistor M21. A voltage at the capacitor C22 is determined using a voltage between the power supply potential PVDD and the reference potential Vs and using a threshold voltage for the capacitor C21.

The transistor M23 is a switch transistor for selecting a pixel circuit to which a data signal is to be supplied and for writing a data signal into the storage capacitor part C20. One terminal that is either the source or the drain of the transistor M23 is connected to the data line 208 for transmitting the data signal Vdata, and the other terminal thereof is connected to the storage capacitor part C20. More specifically, the one terminal that is either the source or the drain of the transistor M23 is connected to the one end of the capacitor C21.

The transistor M23 has a gate connected to the scanning line 201 for transmitting the selection signal Sn. The transistor M23 is controlled using the selection signal Sn supplied from the scanning driver 31. When the transistor M23 is on, the transistor M23 applies the data signal Vdata to the storage capacitor part C20 having been supplied from the driver IC 34 through the data line 208.

The exemplary configuration of the pixel circuit described by referring to FIG. 7 includes the first threshold compensation switch transistor M24 and the second threshold compensation switch transistor M26. The storage capacitor part includes the first capacitor C21 and the second capacitor C22 connected in series between the power supply line 205 for transmitting the first power supply potential PVDD and the gate of the driving transistor M21. A potential at the node between the first capacitor C21 and the second capacitor C22 is applied to one of the source and the drain of the driving transistor M21.

The first threshold compensation switch transistor M24 in an on state applies the reference potential Vs to a node between the storage capacitor part C20 and the gate of the driving transistor M21. The second threshold compensation switch transistor M26 in an on state applies the second power supply potential Vrst to the other one of the source and the drain of the driving transistor. The data signal switch transistor M23 in an on state supplies a data signal to the node between the storage capacitor part C20 and the gate of the driving transistor M21.

A timing chart for signals used for controlling the pixel circuit 120 is similar to that shown in FIG. 3. In the pixel circuit 120, using the two control signals Sn and En also allows a threshold compensation for the driving transistor to be made correctly, allows an anode potential at the OLED element to be reset, and allows a data signal to be written appropriately.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device comprising:

pixel circuits in a plurality of rows; and a control circuit, wherein each pixel circuit of the pixel circuits in the plurality of rows includes:

a driving transistor that controls an amount of current into a light-emitting element;

a light-emission control switch transistor that switches between on and off of current supply to the light-emitting element;

a storage capacitor part with a first capacitor and a second capacitor connected in series from a power supply line;

a threshold compensation switch transistor for applying a threshold compensation voltage to the storage capacitor part; and a data signal switch transistor for applying a data signal to the storage capacitor part, wherein the data signal switch transistor is a P-type transistor, the light-emission control switch transistor and the threshold compensation switch transistor are transistors having different conductivity types, a gate potential at the light-emission control switch transistor and a gate potential at the threshold compensation switch transistor are controlled using a first control signal, a gate potential at the data signal switch transistor is controlled using a second control signal, a gate potential at the driving transistor is controlled using a storage voltage at the storage capacitor part, the control circuit selects the plurality of rows sequentially, in a selected one of the rows, the light-emission control switch transistor is maintained off and the threshold compensation switch transistor is maintained on using the first control signal, and the data signal switch transistor is maintained off using the second control signal in a first period, in the selected row, the light-emission control switch transistor is maintained on and the threshold compensation switch transistor is maintained off using the first control signal, and the data signal switch transistor is maintained on using the second control signal in a second period after the first period, and the first period is three times or more greater than the second period.

2. The display device according to claim 1, wherein the threshold compensation switch transistor is an oxide semiconductor thin film transistor, and the driving transistor is a low-temperature polysilicon thin film transistor.

3. The display device according to claim 1, wherein a time difference exists between a first time of an end of the first period and a second time of a start of the second period.

4. The display device according to claim 1, wherein a time difference exists between a third time of an end of the second period and a fourth time of an end of the first period in a next row.

5. The display device according to claim 1, wherein the control circuit includes:

a first control driver that outputs the first control signal; and a second control driver that outputs the second control signal, and the first control driver and the second control driver are arranged on opposite sides across a display region.

6. The display device according to claim 1, wherein each pixel circuit of the pixel circuits in the plurality of rows further includes a reset switch transistor for applying a reset potential to the light-emitting element, the reset switch transistor has a conductivity type same as that of the threshold compensation switch transistor, and the reset switch transistor is turned on and off using the first control signal.

7. The display device according to claim 1, wherein each of the pixel circuits includes a first threshold compensation switch transistor and a second threshold compensation switch transistor including the threshold compensation switch transistor, the first threshold compensation switch transistor and the second threshold compensation switch transistor have the same conductivity type and are controlled using the first control signal, the storage capacitor part includes a first capacitor and a second capacitor connected in series between a power supply line for transmitting a power supply potential and the gate of the driving transistor, the first threshold compensation switch transistor in an on state supplies a reference potential to a node between the first capacitor and the second capacitor, the second threshold compensation switch transistor in an on state connects the gate and the drain of the driving transistor to each other, and the data signal switch transistor in an on state supplies the data signal to the node between the first capacitor and the second capacitor.

8. The display device according to claim 1, wherein each of the pixel circuits includes a first threshold compensation switch transistor and a second threshold compensation switch transistor including the threshold compensation switch transistor, the first threshold compensation switch transistor and the second threshold compensation switch transistor have the same conductivity type and are controlled using the first control signal, the storage capacitor part includes a first capacitor and a second capacitor connected in series between a power supply line for transmitting a power supply potential and both of a source/drain of the first threshold compensation switch transistor and a source/drain of the data signal switch transistor, the driving transistor has a gate to which a potential at a node between the first capacitor and the second capacitor is applied, and the second threshold compensation switch transistor in an on state connects the gate and the drain of the driving transistor to each other.

9. The display device according to claim 1, wherein each of the pixel circuits includes a first threshold compensation switch transistor and a second threshold compensation switch transistor including the threshold compensation switch transistor, the first threshold compensation switch transistor and the second threshold compensation switch transistor have the same conductivity type and are controlled using the first control signal, the storage capacitor part includes a first capacitor and a second capacitor connected in series between a power supply line for transmitting a first power supply potential and the gate of the driving transistor, a potential at a node between the first capacitor and the second capacitor is applied to one of a source and a drain of the driving transistor, the first threshold compensation switch transistor in an on state supplies a reference potential to a node between the storage capacitor part and the gate of the driving transistor, the second threshold compensation switch transistor in an on state applies a second power supply potential to the other of the source and the drain of the driving transistor, and the data signal switch transistor in an on state supplies the data signal to the node between the storage capacitor part and the gate of the driving transistor.

* * * * *